US007209690B2

(12) United States Patent
Koyanagi et al.

(10) Patent No.: US 7,209,690 B2
(45) Date of Patent: Apr. 24, 2007

(54) DEVELOPING APPARATUS

(75) Inventors: Masato Koyanagi, Mishima (JP); Tetsuya Kobayashi, Numazu (JP); Shinya Yamamoto, Numazu (JP); Kohei Matsuda, Shizuoka-ken (JP); Shinichi Agata, Shizuoka-ken (JP); Kentarou Kawata, Numazu (JP); Yuji Moriki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 185 days.

(21) Appl. No.: 11/090,282

(22) Filed: Mar. 28, 2005

(65) Prior Publication Data

US 2005/0214032 A1 Sep. 29, 2005

(30) Foreign Application Priority Data

Mar. 29, 2004 (JP) ..... 2004-097060

(51) Int. Cl.
*G03G 15/08* (2006.01)

(52) U.S. Cl. ..... 399/279; 430/111.4

(58) Field of Classification Search ..... 399/222, 399/252, 279, 281, 283, 284, 285, 286; 430/111.4, 430/110.4, 110.3
See application file for complete search history.

(56) References Cited

U.S. PATENT DOCUMENTS

| | | | | |
|---|---|---|---|---|
| 5,128,722 | A * | 7/1992 | Natsuhara et al. | 399/280 |
| 5,307,127 | A | 4/1994 | Kobayashi et al. | |
| 6,002,903 | A * | 12/1999 | Hayase et al. | 430/45 |
| 6,132,915 | A * | 10/2000 | Yoshino et al. | 430/102 |
| 6,178,306 | B1 * | 1/2001 | Mizoguchi et al. | 399/276 |
| 6,235,441 | B1 * | 5/2001 | Tanikawa et al. | 430/108.21 |
| 6,873,816 | B2 * | 3/2005 | Akashi et al. | 399/286 |
| 7,054,583 | B2 * | 5/2006 | Hirobe | 399/269 |
| 2002/0048713 | A1 * | 4/2002 | Komoto et al. | 430/124 |
| 2003/0186148 | A1 * | 10/2003 | Nakamura et al. | 430/107.1 |
| 2004/0229143 | A1 * | 11/2004 | Umemura et al. | 430/108.4 |

FOREIGN PATENT DOCUMENTS

| | | | |
|---|---|---|---|
| JP | 6-59502 | | 3/1994 |
| JP | 9-311499 | | 12/1997 |
| JP | 2002-304053 | | 10/2002 |
| JP | 2002304053 | A * | 10/2002 |
| JP | 2004029574 | A * | 1/2004 |

* cited by examiner

*Primary Examiner*—Robert Beatty
(74) *Attorney, Agent, or Firm*—Fitzpatrick, Cella, Harper & Scinto

(57) ABSTRACT

A developing apparatus including: a developer carrying member for carrying a developer, the developer carrying member being provided with an elastic layer and adapted to develop, with a developer, an electrostatic image formed on an image bearing member; wherein the developer includes a toner, the toner has a shape factor SF-1 of 100 or more but less than 130, the toner has a storage modulus G' (140° C.) at 140° C. of $2.0\times10^3$ dN/m$^2$ or more but less than $2.0\times10^4$ dN/m$^2$, the toner has a temperature, when the toner has a viscosity of $1.0\times10^3$ Pa·s in a flow tester temperature elevation method, of 115° C. or more but less than 130° C., and, in a surface roughness of the developer carrying member, a center-line mean roughness Ra, a ten-point mean roughness Rz and a mean spacing Sm of irregularities satisfy following relationships (1):

$$\left.\begin{array}{l} 0.06 \le Rz/Sm \le 0.4 \\ 0.8 \le Ra \le 2.0\ (\mu m) \end{array}\right\}. \quad (1)$$

16 Claims, 7 Drawing Sheets

DEVELOPING APPARATUS

BACKGROUND OF THE INVENTION

1. Field of the Invention

The present invention relates to a developing apparatus for developing an electrostatic latent image formed on an image bearing member with a developer, adapted for use in an image forming apparatus such as a copying apparatus or a printer.

2. Related Background Art

An image forming apparatus utilizing an electrophotographic process is utilized, in addition to a copying apparatus, as an electrophotographic image forming apparatus such as a printer or a facsimile apparatus. Particularly in a printer or a facsimile, for the purpose of reducing the dimension of a copying apparatus portion and of facilitating maintenance, a unit formation is progressing in a developing unit constructed around a developing apparatus and a drum unit constructed around an electrostatic latent image bearing member (image bearing member), and a process cartridge integrating these units is employed frequently.

Also such process cartridge often adopts a one-component developing method which is advantageous for achieving a compact structure.

The one-component development method utilizes a one-component developer (toner), and is executed in a developing apparatus having a developer regulating member such as a developing blade and a developer carrying member such as a developing roller. In the developing apparatus for executing the one-component development method, the developing roller is positioned opposed to an image bearing member such as a photosensitive drum, on which an electrostatic latent image to be developed is formed, scoops up the toner from the interior of the developing apparatus and carries it on a roller surface by a rotary motion to a development area. Along the periphery of the developing roller and between a portion for scooping up the toner and a developing area, there is formed a portion opposed to a front end of the developing blade. In such opposed portion, toner particles are given a charge by a friction between the developing blade and the toner particles and by a friction between the developing roller and the toner particles, and are coated as a thin layer on the developing roller, whereby the toner is carried to the developing area where the developing roller and the image bearing member are mutually opposed to develop the electrostatic latent image on the image bearing member, thereby obtaining a visible toner image.

Different from a two-component developing method requiring carrier particles such as glass beads, iron powder or ferrite, the one-component developing method can dispense with such carrier particles and can achieve a small and lighter structure in the developing apparatus itself. Also the two-component developing method requires, in order to maintain a constant concentration of the toner in the developer, an apparatus of detecting a toner concentration and replenishing a necessary amount of the toner and leads to a larger and heavier structure of the developing apparatus, while the one-component developing method does not require such apparatus. For these reasons, the one-component developing method is advantageous for achieving a smaller and lighter structure.

In a full-color developing apparatus, it is not desirable, from the standpoint of color reproducibility, to include a magnetic powder which is generally colored in a full-color developer as a one-component developer. For this reason, a non-magnetic toner is widely employed as the developer.

On the other hand, there are required a printer and a copying apparatus capable of printing at a more printing speed. For meeting such requirement, an increase in the process speed is an issue to be considered, and, within an image forming process, a matching of a fixing apparatus and a toner in a fixing step, which is executed for fixing the toner on a recording medium in a step after a developing step.

Also in the fixing step, there is desired an improvement in usability such as a reduction of an electric power consumption and a quick start capability. In consideration of such situation, there is proposed a fixing apparatus of a film heating type, having a low heat capacity.

In the fixing apparatus of such film heating type, a nip portion is formed by pinching a heat-resistant film (fixing film) between a ceramic heater constituting a heating member and a pressure roller serving as a pressure member, and a recording medium bearing an unfixed toner image, to be fixed, is introduced between the film and the pressure roller in such nip portion and is conveyed together with the film, whereby, in the nip portion, the heat of the ceramic heater is given to the recording medium across the film and the unfixed toner image is fixed to the surface of the recording medium by the heat and pressure of the nip portion.

The fixing apparatus of such film heating method is characterized in that an apparatus of on-demand type can be constructed by employing members of a low heat capacity for the ceramic heater and the film, and by energizing the ceramic heater as the heat source to a predetermined fixing temperature only during an image formation of the image forming apparatus thereby providing advantages of a short waiting time from a turning-on of the power supply of the image forming apparatus to a state capable of executing an image formation (quick starting property) and a significantly smaller electric power consumption in a stand-by state (power saving).

However, the fixing apparatus of such film heating type is insufficient in a heat amount as a fixing apparatus of a full-color image forming apparatus or a high-speed image forming apparatus requiring a large heat amount for image fixing, and causes drawbacks such as a defective fixation, an unevenness in luster (gloss unevenness) in the fixed image and a toner offsetting, for which further improvements are desired.

As a result of detailed investigation with an image forming apparatus equipped with a fixing apparatus of film heating type, the present inventors have found that an image defect such as an unevenness in the gloss or an offsetting as mentioned above tends to be caused at a high-speed printing, regardless of the pressure in the fixing nip portion. Such phenomena are particularly conspicuous in case a thick paper (with a basis weight of 105 g or more) is employed as a recording paper.

For suppressing such phenomena, there is known a method of reducing a viscoelasticity of the toner, but such method, in a high-speed printing, causes an image defect by a fused toner bonding onto the surface of the developing roller, and various countermeasures thereto are being desired.

Also for enabling an image fixing with a low energy and presenting a stain caused by an offsetting phenomenon, there is known a method, as described in Japanese Patent Application Laid-Open No. H09-311499, of defining a temperature and a storage modulus of a one-component developer.

Also for matching with an oilless fixing operation with a Teflon roller, there is known a method, as described in Japanese Patent Application Laid-Open No. H06-59502, of defining a temperature and a storage modulus of a developer.

SUMMARY OF THE INVENTION

An object of the present invention is to provide a developing apparatus capable of suppressing a fused toner bonding onto a developer carrying member.

Another object of the present invention is to provide a developing apparatus capable of employing a toner that can suppress a fixing failure.

Still another object of the present invention is to provide a developing apparatus capable of employing a toner that does not cause an image defect such as a gloss unevenness or an offsetting at the fixing operation.

Still another object of the present invention is to provide a developing apparatus capable of achieving a high speed.

Still other objects of the present invention, and features thereof, will become fully apparent from the following detailed description to be taken in conjunction with the accompanying drawings.

DETAILED DESCRIPTION OF THE PREFERRED EMBODIMENTS

Now the developing apparatus of the present invention will be clarified further with reference to the accompanying drawings. The following examples are shown in a merely illustrative purpose, and a dimension, a material, a shape, a relative position and the like of components are not to restrict the range of the present invention to such description unless specified otherwise.

EXAMPLE 1

Figure 1:
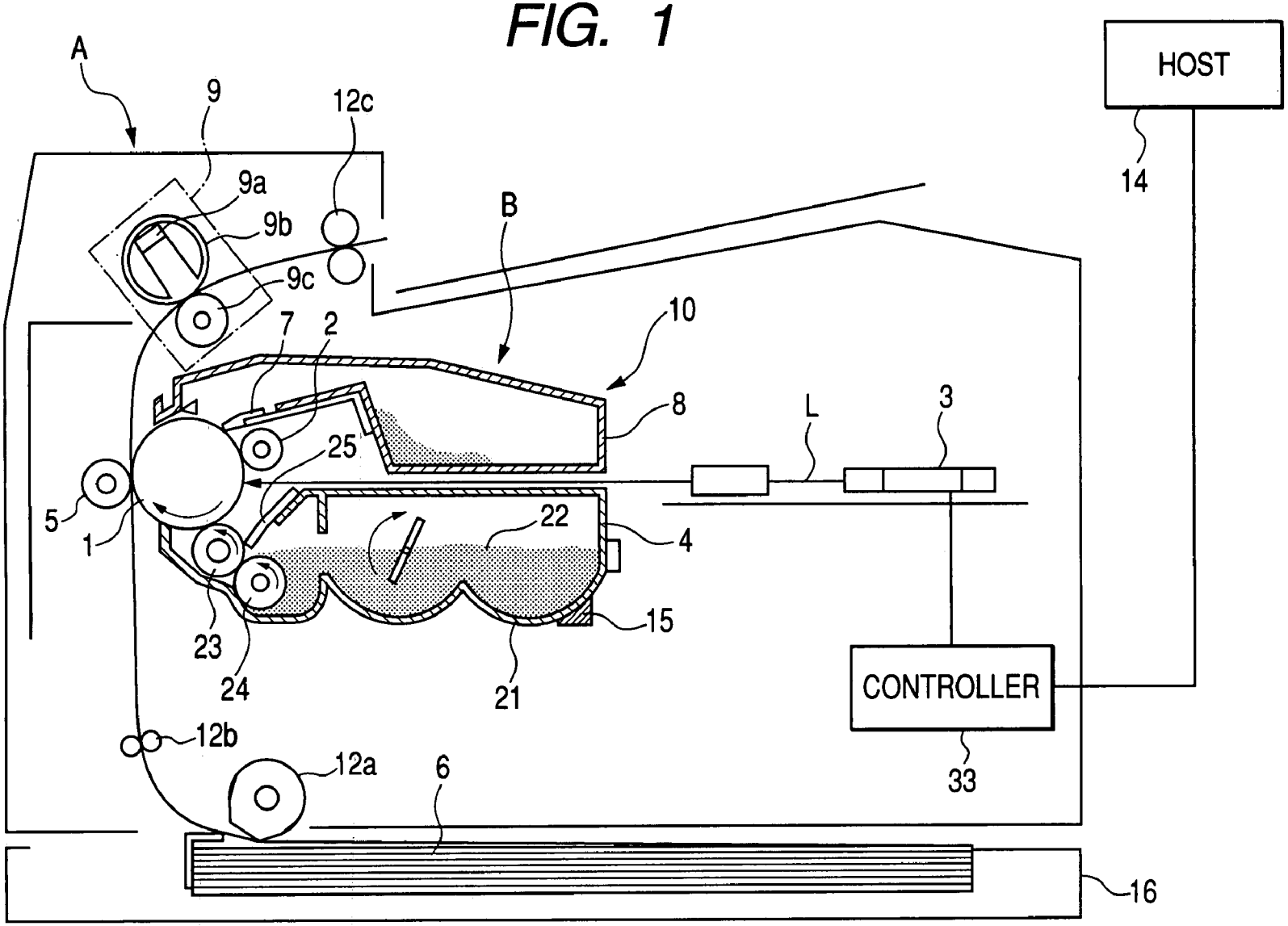
FIG. 1 is a schematic view showing a configuration of an image forming apparatus embodying the present invention.

FIG. 1 is a schematic cross-sectional view of an example of an image forming apparatus capable of utilizing a developing apparatus of the present invention. The image forming apparatus of the present example is a laser beam printer for forming an image by an electrophotographic process according to image information, on a recording medium 6 such as a recording paper or an OHP sheet. The image forming apparatus is provided with a main body A of the image forming apparatus, and a process cartridge B, wherein the process cartridge B is detachably mounted in the main body A of the image forming apparatus as will be described later in more details.

The image forming apparatus is used by connecting to a host apparatus 14 such as a personal computer. The process cartridge B is provided with a photosensitive member (photosensitive drum) 1 of a drum shape as an image bearing member, and image forming means is provided along an external periphery of the photosensitive drum 1. In the course of rotation of the photosensitive drum 1, such image forming means forms a developer image (toner image) on the periphery of the photosensitive drum 1, based on the information from the host apparatus 14.

In a charging step within the image forming process, the photosensitive drum 1 is uniformly charged by charging means, which is one of image forming means around the photosensitive drum and is a roller-shaped charging member pressed to the photosensitive drum 1, namely a contact charging roller (charging roller) 2. The charging roller 2 is given, as a charging bias, a DC voltage fixed at a predetermined value, thereby charging uniformly and negatively the surface of the photosensitive drum 1. The charging roller 2 is rotated by the rotation of the photosensitive drum 1. The charging roller 2 is contacted a substantially entire area of the photosensitive drum 1 in a longitudinal direction (perpendicular to a conveying direction of the recording medium) thereof.

Subsequently, a controller 33 in the main body A of the image forming apparatus processes a print request signal and image data from the host apparatus 1, and controls a scanner 3 constituting exposure means, thereby forming an electrostatic latent image on the photosensitive drum 1. More specifically, the uniformly charged photosensitive drum 1 is exposed to a laser light from the scanner 3 constituting the exposure means, thereby forming an electrostatic latent image on the surface (exposure step). The scanner 3 includes a laser light source, a polygon mirror, an lens system and the like (those not illustrated) and can execute a scanning exposure on photosensitive drum 1 under the control of the controller 33.

Thereafter, the electrostatic latent image receives a supply of a developer by a developing apparatus 4, and is developed into a visible toner image (developing step). The developing apparatus 4 employed in the image forming apparatus adopts a one-component development method and is provided with a development container 21 containing a negatively chargeable non-magnetic toner (toner) 22 as the one-component developer. The present example employs, as the toner 22, a substantially spherical toner of a volume-average particle diameter of about 6 μm, having a low viscoelasticity and showing excellent fixing characteristics at a high-speed printing.

A part of the developing container 21 opposed to the photosensitive drum 1 has an aperture over a substantially entire length of the photosensitive drum 1 in the longitudinal direction thereof, and a developing roller 23 as a roller-shaped developer carrying member (developing means) is provided in such aperture. The developing roller 23 is pressed and abutted so as to form a predetermined penetration amount on the photosensitive drum 1 positioned in an upper left portion of the developing apparatus 4 in the illustration, and is rotated forwards with respect to the photosensitive drum 1.

In a lower right portion of the developing roller 23 in the illustration, an elastic supply roller 24 is contacted for a toner supply to the developing roller 23 and for peeling an undeveloped toner from the developing roller 23. The supply roller 24 is rotatably supported in the developing container 21. In consideration of ability of toner supply to the developing roller 23 and toner peeling of the undeveloped toner, the supply roller 24 is formed by a sponge roller, which is rotated in a direction same as that of the developing roller 23.

The developing apparatus 4 is further provided with a developing blade 25, as a developer regulating member for regulating a toner amount to be carried on the developing roller 23. The developing blade 25 is formed by an elastic phosphor bronze metal plate, and is so provided that a vicinity of a free front end abuts, by an area contact, on the external periphery of the developing roller 23. Thus, the free end of the developing blade 25 is separated from the developing roller 23. The toner carried on the developing roller 23 by the friction with the supply roller 24, upon passing through the abutting portion with the developing blade 25, is given a triboelectric charge by a frictional charging, and is also regulated into a thin layer.

In the developing apparatus 4 employing the one-component developing method in the aforementioned configuration, the developing roller 23 is given a predetermined DC voltage as a developing bias. In the present example, on the surface of the uniformly charged photosensitive drum 1, an exposed area in which the negative charge is attenuated is reversal developed with the negatively charged toner to obtain a developer image (toner image).

While a toner image is formed on the photosensitive drum 1 as explained above, a recording medium 6 is separated and fed by a feed roller 12*a* from a recording medium container 16, and is once stopped at registration rollers 12*b*. The registration rollers 12*b* synchronizes a recording position on the recording medium 6 with a timing of formation of a toner image on the photosensitive drum 1, and advances the recording medium 6 toward an opposed portion (transfer portion) of a transfer roller 5 constituting transfer means and the photosensitive drum 1. Thus the visible toner image on the photosensitive drum 1 is transferred, by the function of the transfer roller 5, onto the recording medium 6 (transfer step).

The recording medium 6, having received the transferred toner image, is conveyed to a fixing apparatus 9. In the fixing apparatus 9, the unfixed toner image on the recording medium 6 is permanently fixed by heat and pressure onto the recording medium 6 (fixing step).

The fixing apparatus 9 is an apparatus of a film heating type as explained in the prior technology, in which a heater 9*a* executes heating, thereby fixing an image onto the recording medium 6 pinched and conveyed between a film 9*b* provided around the heater 9*a* and a pressure roller 9*c*.

Thereafter, the recording medium 6 is discharged by discharge rollers 12*c* from the apparatus (end of an image forming cycle).

Also a transfer residual toner, not transferred but remaining on the photosensitive drum 1, is cleaned by cleaning means (cleaner) 10. More specifically, the cleaner 10 scrapes off the transfer residual toner by a cleaning blade 7 constituting a cleaning member from the photosensitive drum 1, and stores such toner in a used toner container 8. Thus cleaned photosensitive drum 1 is subjected to a next image formation.

The image forming apparatus of the present example adopts a process cartridge system in which an electrophotographic photosensitive member (photosensitive drum 1) serving as an image bearing member and image forming means (charging roller 2, developing apparatus 4 and cleaner 10) acting on the image bearing member are integrally constructed as a cartridge, and such cartridge B is rendered detachably mountable on the main body A of the image forming apparatus.

The image forming means includes charging means (charging roller 2) for charging the electrophotographic photosensitive member (photosensitive drum 1), developing means (developing apparatus 4) for supplying the electrophotographic photosensitive member with a developer (toner), and cleaning means (cleaner 10) for cleaning the electrophotographic photosensitive member. The process cartridge B constructs at least one of the charging means, the developing means and the cleaning means and the electrophotographic photosensitive member as an integral cartridge, which is rendered detachably mountable in the main body of the electrophotographic image forming apparatus. Preferably, the cartridge integrally includes at least the developing means and the electrophotographic photosensitive member as an integral cartridge.

In the present example, the process cartridge B is detachably mounted in the main body A, by mounting means 15 provided in the main body A of the image forming apparatus.

Now, a content of the present invention will be explained in detail.

For obtaining excellent developing characteristics and fixing characteristics even in a high-speed printing operation as objectives of the present invention, the present example includes improvements on a toner 22 contained in the developer, and on a developing roller 23 constituting a developer carrying member.

As the toner 22, there is employed a non-magnetic toner having following characteristics (1) to (4), more specifically a substantially spherical toner having a volume-average particle diameter of about 6 μm and a low viscoelasticity showing excellent fixing characteristics in a high-speed printing operation as explained before. The toner contains at least a binder resin and a colorant. Also the developer may contain inorganic fine particles externally added to the toner.

(1) At first, a volume-average particle diameter of the toner is selected within a range of 4 to 10 μm. A volume-average particle diameter less than 4 μm tends to cause an excessive charging (charge-up) of the toner, thus undesirably generate a negative ghost. Also a volume-average particle diameter exceeding 10 μm results in an undesirable image lacking a high definition.

The volume-average particle diameter of the toner is measured, for example, by a following method.

The measurement is executed by a Coulter Counter type TA-II (manufactured by Coulter Inc.), which is connected with an interface for outputting a number-average distribution (manufactured by Nikkaki Co.) and a personal computer CX-I (manufactured by Canon Inc.). Also as an electrolyte, a 1% NaCl aqueous solution is prepared with reagent grade sodium chloride. In 100 to 150 ml of the aqueous electrolyte solution, 0.1 to 5 ml of a surfactant as a dispersant (preferably alkylbenzenesulfonic acid) are added, and 0.5 to 50 mg of a sample for measurement are added. The electrolyte solution suspending the sample is subjected to a dispersion for about 1 to 3 minutes by an ultrasonic disperser, and is subjected to a particle size distribution of particles of 2 to 40 μm with an aperture of 100 μm on the Coulter Counter Type TA-II to determine a volume distribution. A volume-average particle diameter of the sample can be obtained from thus measured volume distribution.

(2) A shape factor SF1 of the toner is selected as 100 or larger but smaller than 130, preferably 100 or larger but smaller than 125. This is because toner particles closer to spherical shape have less spaces between the toner particles in an unfixed image thereby realizing a more uniform heat transmission to the entire toner particles, while distorted toner particles result in a fluctuation in the spaces between the toner particles in the unfixed toner image, thus resulting in an uneven heat transmission to the toner particles and leading to a defective fixing. More specifically, a toner image may be peeled off when the surface of the fixed image is rubbed.

A shape factor SF1 of the toner is defined by randomly sampling images of 100 particles of a magnification of 500 times obtained by an electron microscope FE-SEM (S-800, manufactured by Hitachi Ltd.) then introducing the image information into an image analyzing apparatus Luzex 3 (manufactured by Nicolet Co.) through an interface and executing can analysis according to an equation (8):

$$SF1=\{(MXLNG)^2/\mathrm{AREA}\}\times(\pi/4)\times 100 \quad (8)$$

wherein AREA: projected area of toner

MXLNG: absolute maximum length (3) The toner has a storage modulus G' (140°) at 140° C. of $2.0\times10^3$ dN/m$^2$ or larger but smaller than $2.0\times10^4$ dN/m$^2$, preferably $2.0\times10^3$ dN/m$^2$ or larger but smaller than $1.0\times10^4$ dN/m$^2$. In this manner, preferable thermal characteristics can be obtained in a binder portion of the toner.

(4) A measuring temperature when the toner shows a viscosity of $1.0\times10^3$ Pa·s in a flow tester temperature elevation method is selected as 115° C. or more but lower than 130° C., preferably 115° C. or more but lower than 125° C. In this manner preferable thermal characteristics can be obtained in the entire toner, including influences of a releasing agent and a colorant.

(5) In case a wetting property of the toner by a methanol/water mixed solvent is measured by an optical transmittance at a wavelength of 780 nm, a methanol concentration at a transmittance of 50% is selected within a range of 30 to 60 vol. %. In case a methanol concentration at a transmittance of 50% is less than 30 vol. %, the toner includes a large amount of a hydrophilic substance in the surface layer and is easily wettable, thus easily influenced by a moisture in the air and becoming inferior in the uniformity of image gloss. On the other hand, in case a methanol concentration at a transmittance of 50% exceeds 60 vol. %, the toner becomes less wettable and provides an excellent uniformity in the image gloss, but a storage property becomes insufficient in case a wax amount on the surface is excessively large, and the fixed image becomes insufficient in the uniformity in case the externally added fine particles are inadequate in amount or in material.

(6) In the toner, a principal component of the binder resin is formed by a styrene-acryl compound, because this material can provide a toner showing little change in the developing characteristics even in a prolonged use, thus excellent in durability.

On the toners 22 of the present example having the aforementioned properties (1) to (6), results of comparison on a fixing property and a durability (fog) in 20,000 image formations are shown in Table 1.

As the toner 22 of the present example, there were employed toners 22*a*, 22*b* having physical values within ranges defined in (1) to (6) above.

Also as comparative examples, there were employed five toners 22*c*, 22*d*, 22*e*, 22*f* and 22*g* which satisfy the condition (1) of having a volume-average particle diameter of 4 to 10 μm and condition (6) that the binder resin contains a styrene-acryl compound but are changed in the values of (2), (3), (4) and (5).

TABLE 1

| | shape factor SF1 | storage modulus at 140° C. G'(140° C.) (dN/m$^2$) | measuring temp. when toner viscosity in flow tester temp. elevating method becomes $1.0\times10^3$ Pa · s (° C.) | methanol concentration to water at transmittance 50% in wetting test | fixing property, offset, image gloss, uniformity | fog after 20,000 image formations |
|---|---|---|---|---|---|---|
| toner 22a | 117 | $7.0\times10^3$ | 117 | 50 | + | ± |
| toner 22b | 121 | $1.5\times10^4$ | 127 | 57 | + | − |
| toner 22c | 127 | $3.1\times10^3$ | 123 | 27 | + | ± |
| toner 22d | 104 | $9.1\times10^3$ | 120 | 63 | + | − |
| toner 22e | 124 | $1.0\times10^3$ | 137 | 33 | − | + |
| toner 22f | 122 | $7.0\times10^3$ | 105 | 67 | − | ± |
| toner 22g | 133 | $4.2\times10^4$ | 122 | 55 | − | − |

Comparison of Fixing Ability and Durability of the Toner of the Present Example and Toner of Prior Technology The image formation was conducted in an environment of a normal temperature and a normal humidity (25° C./60%), and the developing roller 23 had a surface roughness of Ra=0.8 μm, Rz=8 μm and Sm=200 μm.

A fog in the present example is a drawback that the toner cannot be sufficiently triboelectrically charged and is deposited on a solid white background, and (+) indicates an absence of deposition on the paper, (±) indicates a slightly noticeable deposition and (−) indicates a conspicuously noticeable deposition.

With respect to the fixing property such as offsetting, image gloss and uniformity, the toners 22*a* and 22*b* of the present example and the toners 22*c* and 22*d* which did not meet the condition (5) only were superior to the toners 22*e*, 22*f* and 22*g* which did not meet the physical values (2) to (4). Therefore, with respect to the fixing property intended in the present invention can be improved by meeting the physical values for (1) particle diameter, (2) shape factor, (3) storage modulus and (4) viscosity mentioned above, and the condition for (5) wetting property mentioned above is adopted for obtaining uniformity.

In the toners 22*a* to 22*d* showing satisfactory fixing property, the fog was worsened with an increase in the storage modulus G' (140° C.) (dN/m$^2$) at 140° C. The fog in this experiment is caused by a decrease in the triboelectric charging property by a fused toner bonding to the surface of the developing roller 23, and results from a fact that a softer toner is more easily fused by the friction with the developing blade 25.

Also the developing roller 23 employed in the present example was an elastic roller having at least an elastic layer and a thin surface layer on a metal core, in order to facilitate regulation of physical properties such as a surface roughness, a resistance and a hardness. More specifically, there was employed a developing roller having a silicone rubber layer as an elastic base layer, coated thereon with an urethane resin layer containing urethane particles as a surface layer. In the following, a surface roughness of such developing roller 23 will be considered.

The surface roughness of the developing roller 23 is represented, according to JIS B 0601 (1994), by Ra (center-line mean roughness), Rz (ten-point mean roughness) and Sm (mean spacing of irregularities). More specifically, when a roughness curve is extracted by a portion of 2.5 mm as a measuring length along a center line and such extracted portion is represented by y=f(x) with X-axis along a center line of the extracted portion and Y-axis along a direction of vertical magnification, Ra is given a value in micrometer (μm) obtained from a following equation (9):

$$Ra=1/a\int_0^a|f(x)|dx \tag{9}$$

Figure 2A:
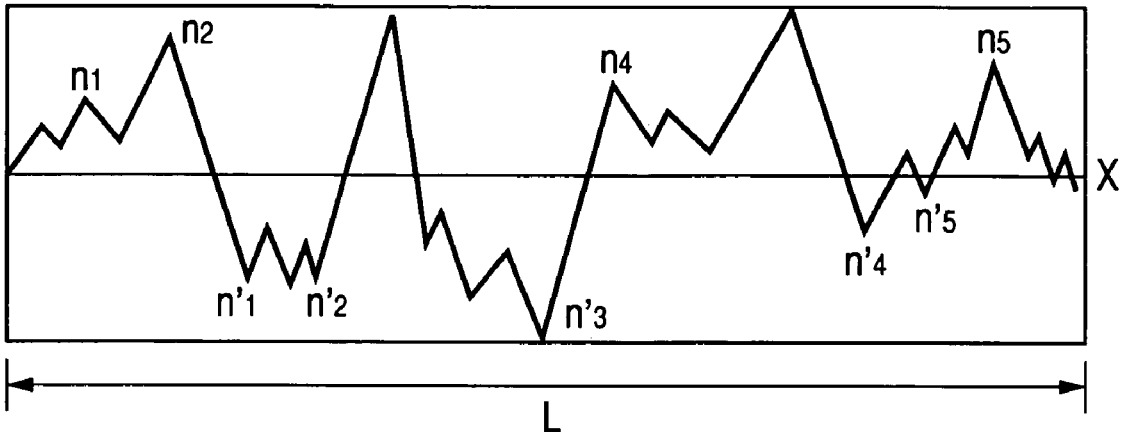
FIG. 2A is a schematic view showing a calculating method for a surface roughness Rz of the invention.
Figure 2B:
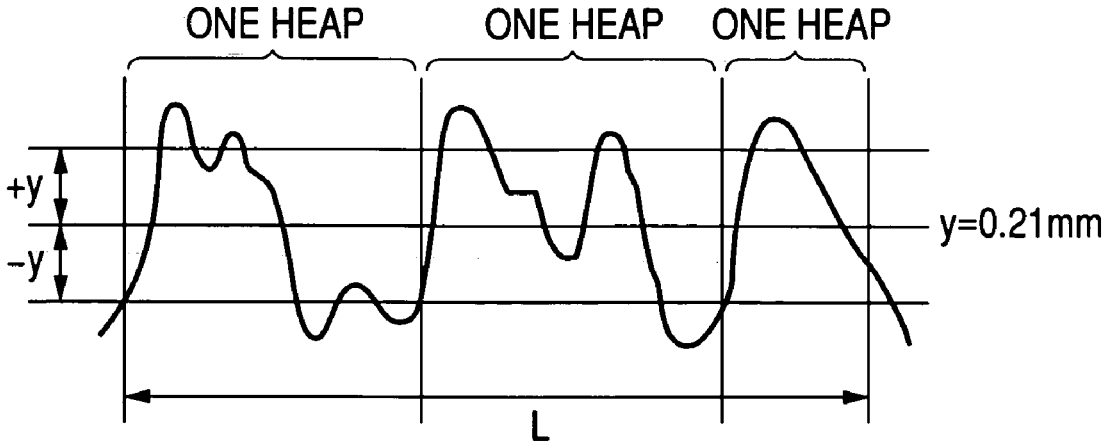
FIG. 2B is a schematic view showing a calculating method for a mean spacing Sm of irregularities in the invention.

Rz and Sm are calculated by equations (10) and (11) from the data of a surface roughness measuring instrument, as shown in FIGS. 2A and 2B. A Surfcorder SE-3400 manufactured by Kosaka Kenkyusho Co as the surface roughness measuring instrument.

Rz is calculated by taking ten values, namely five larger values and five smaller values than an intermediate value X of the surface height, obtained by the surface roughness measuring instrument as shown in FIG. 2A and using such values n1–n5, and n'1–n'5 in an equation (10):

$$Rz = \frac{(n1 + \ldots + n5) - (n'1 + \ldots + n'5)}{5} \tag{10}$$

Sm is calculated from a following equation (11) employing a number of irregularity heaps within a measured surface distance L, wherein a heap means a distance in which the surface irregularity makes a cycle between a maximum value and a minimum value:

$$Sm = \frac{L}{n} \tag{11}$$

In the following there will be explained, within the results shown in Table 1, an effect of the surface roughness of the developing roller 23 in case of employing the toner 22*b* which meets the conditions (1) to (6) and which shows satisfactory fixing property but generates a fog after 20,000 image formations.

The employed developing roller 23 had an Asker-C hardness of 50° and an MD-1 hardness of 40°.

When 20,000 image formations were conducted in the image forming apparatus in an environment of a normal temperature and a normal humidity (25° C./60%), there was obtained a relationship among the surface roughness of the developing roller 23, an initial image density and a durability (fog) as shown in Table 2.

M/S means an amount of the developer per unit area, carried to the developing area after a regulation with the developing blade, and is represented by a unit mg/cm$^2$. A fusion means a fused toner bonding onto the surface of the developing roller, wherein (+) means an absence of fusion and (−) means a presence of fusion.

TABLE 2

| | developing roller surface roughness | | | | initial | | after 20,000 image formations | |
|---|---|---|---|---|---|---|---|---|
| No. | Rz (μm) | Sm (μm) | Rz/Sm | Ra (μm) | density | M/S | fog | fusion bonding |
| 1 | 5 | 30 | 0.167 | 0.75 | − | 0.23 | + | + |
| 2 | 5 | 100 | 0.050 | 0.75 | − | 0.23 | + | − |
| 3 | 5 | 170 | 0.029 | 0.75 | − | 0.23 | − | − |
| 4 | 8 | 30 | 0.267 | 0.8 | + | 0.25 | + | + |
| 5 | 8 | 100 | 0.080 | 0.8 | + | 0.25 | + | + |
| 6 | 8 | 155 | 0.052 | 0.8 | + | 0.25 | + | − |
| 7 | 8 | 200 | 0.040 | 0.8 | + | 0.25 | − | − |
| 8 | 10 | 30 | 0.333 | 1.2 | + | 0.36 | + | + |
| 9 | 10 | 100 | 0.100 | 1.2 | + | 0.36 | + | + |
| 10 | 10 | 170 | 0.059 | 1.2 | + | 0.36 | − | − |
| 11 | 10 | 220 | 0.045 | 1.2 | + | 0.36 | − | − |
| 12 | 12 | 30 | 0.400 | 1.5 | + | 0.43 | + | + |
| 13 | 12 | 100 | 0.120 | 1.5 | + | 0.43 | + | + |
| 14 | 12 | 170 | 0.071 | 1.5 | + | 0.43 | + | + |
| 15 | 12 | 220 | 0.055 | 1.5 | + | 0.43 | − | − |
| 16 | 14 | 30 | 0.467 | 2 | + | 0.5 | (−*) | + |
| 17 | 14 | 100 | 0.140 | 2 | + | 0.5 | + | + |
| 18 | 14 | 170 | 0.082 | 2 | + | 0.5 | + | + |
| 19 | 16 | 50 | 0.32 | 2.1 | + | 0.52 | − | + |
| 20 | 16 | 100 | 0.16 | 2.1 | + | 0.52 | − | + |
| 21 | 16 | 150 | 0.10667 | 2.1 | + | 0.52 | − | + |

(−*) surface layer peeling off

Relationship Among Surface Roughness of Developing Roller, Initial Image Density and Durability in this Example The relationship shown in Table 2 indicates that the initial density is determined by M/S on the developing roller 23, and that M/S is proportional to the surface roughness Ra. In this example, as shown in Table 2, the initial density becomes satisfactory at a surface roughness Ra≧0.8 μm.

The fog in the present example means a drawback that the toner cannot be sufficiently triboelectrically charged and is deposited on a solid white area (non-image area), and two causes are conceivable in the present example.

Cause 1: A decrease in the triboelectric charging property by a fused toner bonding onto the surface of the developing roller 23 after the durability test.

Cause 2: A large surface roughness Ra with a high M/S, incapable of a sufficient triboelectric charging on a deteriorated toner of which triboelectric charging property is lowered after the durability test.

In the present example, as indicated in a column for a fusion after 20,000 image formations in Table 2, the fog based on the cause 1 can be prevented by selecting Rz/Sm≧0.06.

In order to prevent the fog of the cause 2, there is preferably selected Ra≦2.0 (μm) as shown in Table 2. In the present example, it was confirmed that the fog was not generated when the surface roughness Ra is small, even when the fused toner bonding takes plate on the surface of the developing roller 23 as in configurations Nos. 2 and 6.

Also when Rz/Sm was increased in order to increase the surface roughness Ra, a surface layer peeling was encountered as in the configuration No. 16. This was presumably because roughening particles, incorporated in the surface layer in order to form a rough surface on the developing roller was excessively large in the particle diameter and in the amount, thereby reducing the binding strength of the surface layer urethane resin. In order to prevent such surface layer peeling, there is preferably adopted a condition Rz/Sm≦0.4.

Based on these results, the developing roller 23 of the present example has an optimum surface roughness represented by 0.06≦Rz/Sm≦0.4 and 0.8≦Ra≦2.0 μm, and an optimum M/S represented by 0.25≦M/S≦0.5 (mg/cm$^2$). It will be apparent from Table 2 that the fog is not generated at such surface roughness.

The present example explained above allows, by optimizing the surface roughness of the developing roller, to provide an image forming apparatus capable of maintaining a high fixing ability even in a high-speed printing operation, and preventing an image defect caused by a fused toner bonding onto the surface of the developer carrying member.

The present example, therefore, regulates a developer including a non-magnetic toner containing at least a binder resin and a colorant, to be employed in the one-component developing method, and a surface roughness of a developing roller constituting a developer carrying member, and there is preferred a developing apparatus in which the toner satisfies physical properties that (1) a volume-average particle diameter within a range of 4 to 10 μm, (2) a shape factor SF1 of 100 or more but less than 130, (3) a storage modulus G' (140° C.) at 140° C. of $2.0\times10^3$ dN/m$^2$ or more but less than $2.0\times10^4$ dN/m$^2$, and (4) a measuring temperature when the toner shows a viscosity of $1.0\times10^3$ Pa·s in a flow tester temperature elevating method is 115° C. or more but less than 130° C., and in which the developing roller has elasticity and has such a surface roughness that Ra (center-line mean roughness), Rz (ten-point mean roughness) and Sm (mean spacing of irregularities) satisfy following relationships (12). It is thus rendered possible to provide a process cartridge and an image forming apparatus equipped with such developing apparatus, and to suppress a fixing failure or a fog even in an image forming apparatus utilizing a fixing apparatus of film heating type and designed for a higher printing speed.

$$\left.\begin{array}{l} 0.06 \le Rz/Sm \le 0.4 \\ 0.8 \le Ra \le 2.0\ (\mu m) \end{array}\right\} \quad (12)$$

The present invention is also applicable to an image forming apparatus not adopting a process cartridge and can provide similar effects as in the present example also in such case.

EXAMPLE 2

This example explains an influence of a hardness of the developing roller 23 in an image formation utilizing the toner 22*b* shown in Table 1. In the present example, there was employed a developing roller 23 having a surface roughness Ra=1.2 μm, Rz=10 μm and Sm=100 μm meeting the relationships (12) shown above.

Table 3 shows a relationship, after 20,000 image formations in an image forming apparatus under an environment of a normal temperature and a normal humidity (25° C./60%), a hardness of the developing roller 23, an image fog, and surface layer peeling of the roller 23 and a developing line appearing on the image. The developing line is caused by a fused toner bonding onto the developing blade 23 by a friction between the developing roller 23 and the developing blade 25, and is a streak extended in the longitudinal direction (direction of rotation axis) of the developing roller.

TABLE 3

| Asker-C | MD-1 | After 20,000 image formations | |
|---|---|---|---|
| hardness | hardness | Fog | developing line |
| 35 | 20 | − | + |
| 35 | 25 | − | + |
| 35 | 30 | + | + |
| 40 | 20 | − | + |
| 40 | 25 | + | + |
| 40 | 30 | + | + |
| 60 | 45 | + | + |
| 60 | 50 | + | + |
| 60 | 55 | + | − |
| 65 | 45 | + | + |
| 65 | 50 | + | − |
| 65 | 55 | + | − |

Influence of Hardness of Developing Roller in the Present Example

These results indicate that, in case an Asker-C hardness in the entire hardness of the developing roller 23 is low, a deteriorated toner cannot be sufficiently triboelectrically charged, thereby resulting in a deterioration of the fog.

Also it is indicated that a high MD-1 hardness in the measurement of the surface hardness increases a pressure to the toner at the frictional abutment with the developing blade 25, thereby aggravating a developing line.

Based on these results, the present example employing a developing roller 23 of an Asker-C hardness within a range of 40 to 60° and an MD-1 hardness within a range of 25 to 50°. Such developing roller allowed to prevent an image fog, a developing line, and a surface layer peeling of the roller 23.

The Asker-C hardness was measured with an Asker-C spring-type rubber hardness meter (manufactured by Kobunshi Keiki Co.) based on Japanese Rubber Association Standards SRIS0101, and the MD-1 hardness was measured with Micro Durometer MD-1 (manufactured by Kobunshi Keiki Co.).

EXAMPLE 3

In the present example, in an image forming apparatus of a configuration similar to that in Example 1, an even better setting of the developing blade in the developing apparatus 4 is considered.

The developing apparatus shown in FIG. 1 executes, as explained in the example 1, a one-component developing method in which a charge is given to the toner 22 by a friction between the developing blade 25 and the developing roller 23. Therefore a positional arrangement of the developing blade 25 and the developing roller 23 is important, and an abutment pressure P of the blade 25 on the developing roller 23 is considered.

A non-magnetic toner subjected to a spherical treatment is not easily regulated in the coating amount by the developing blade 25 because of the spherical shape. In order to realize a satisfactory image quality, it is necessary to increase a regulating force by the developing blade 25.

Figure 3:
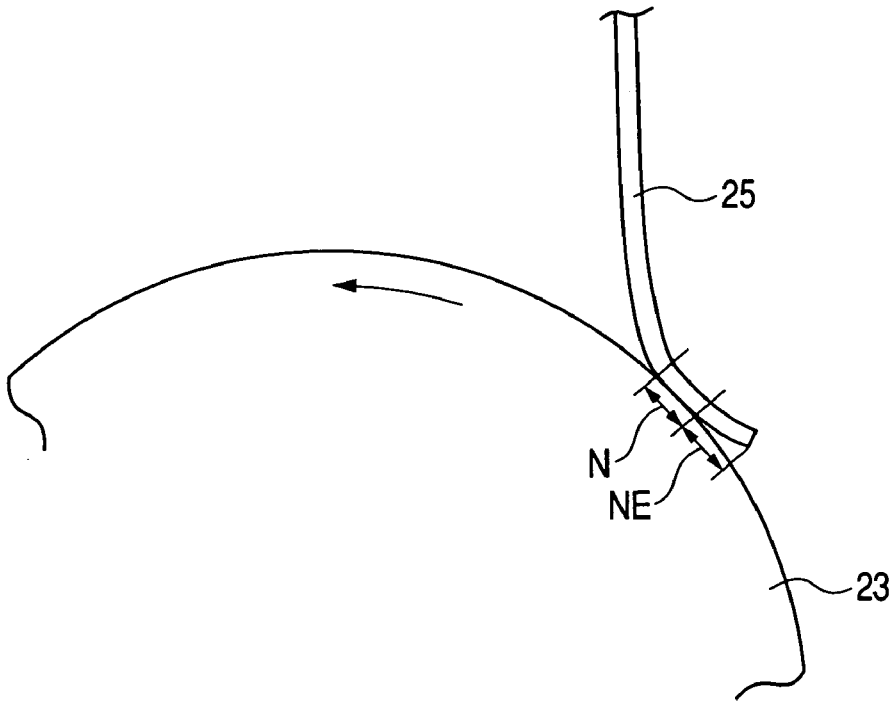
FIG. 3 is a magnified view showing an opposed portion of a developer carrying member and a developer regulating member in the present invention.

An image forming operation was conducted by varying an abutment pressure P of the blade 25 to the developing roller 23, namely a linear pressure (g/cm) of the developing roller 23 per centimeter in a longitudinal direction, and a length NE (mm) shown in FIG. 3. The length NE is a distance between a most upstream position in the rotating direction of the developing roller within an abutment nip N formed by an abutment of the developing blade 25 with the developing roller 23, and a free end of the blade 25.

Figure 4:
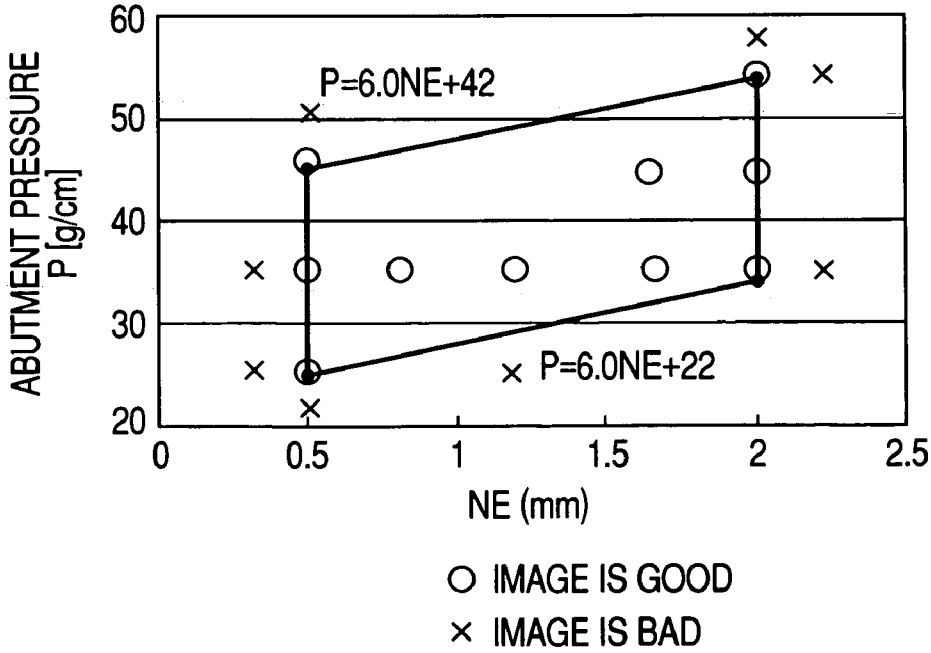
FIG. 4 is a chart showing a relationship between an abutment pressure P of the developer regulating member of the invention to the developing carrying member, and a distance NE between a most downstream abutment position and a free end.

FIG. 4 shows results of such operation. These results indicate that a preferable range of NE is $0.5 \leqq NE \leqq 2.0$ (mm). An NE value less than 0.5 mm may result in a contact by the edge, thus reducing the coated amount of the toner regulated by the blade, and providing a low image density or a white spot in the image. Also an NE value exceeding 2.0 mm increased the coated amount of the toner regulated by the blade, thus resulting in an unstable toner layer formation.

Also a preferable abutment pressure P was identified as $25 \leqq P \leqq 54$ (g/cm). A P value less than 25 g/cm resulted in an insufficient charge amount on the toner, providing a deterioration in the image quality and a low image density. On the other hand, a pressure exceeding 50 g/cm reduces the coated amount of the toner regulated by the blade, whereby an image line appeared broken in a durability running test.

Furthermore, a following relationship was found between P and NE.

In case P is small with a small toner regulating force, the coated amount increases and the image is deteriorated unless NE is made small. With an increase in P, the toner regulating force increases so that the coated layer of the toner is stabilized and the image quality is improved by increasing NE.

The experimental results shown in FIG. 4 can be represented by a relationship (13), which defines the relation of NE and P in FIG. 4 by a straight line $P=6.0\times NE+42$ defining an upper limit and a straight line $P=6.0\times NE+22$ defining a lower limit:

$$6.0\times NE+22 \leqq P \leqq 6.0\times NE+42 \quad (13)$$

It is therefore rendered possible, by an abutment of the developing blade 25 so as to satisfy $0.5 \leqq NE \leqq 2.0$, $25 \leqq P \leqq 54$ and $6.0\times NE+22 \leqq P \leqq 6.0\times NE+42$, to form a stable toner layer with spherical toner particles and to obtain a satisfactory image quality.

In the present example, therefore, the developing blade 25 was installed, in the developing apparatus 4, so as to abut on the developing roller 23 with an abutment pressure P (linear pressure (g/cm) per 1 centimeter in the longitudinal direction of the developing roller) of 40 g/cm.

Also a nip N, corresponding to an abutment width of the developing roller 23 and the blade 25, was selected as 1.5 mm, and NE, which is a distance from the most upstream position of the abutment to the free end of the blade, was selected as 1.0 mm.

In this manner, the toner 22 can be coated satisfactorily on the developing roller 23, thereby preventing image defects such as a white spot in the image, a lowered image density, an unevenness in the density, a line aberration etc.

EXAMPLE 4

The present example further gives consideration, in an image forming apparatus of a configuration similar to that of Example 1, to a surface roughness of the developing roller 23.

Referring to Table 2 in Example 1, there will be considered a reason, for a same Ra value, why a fused toner bonding is reduced on the surface of the developing roller 23 for a larger Rz/Sm value.

Figure 5A:
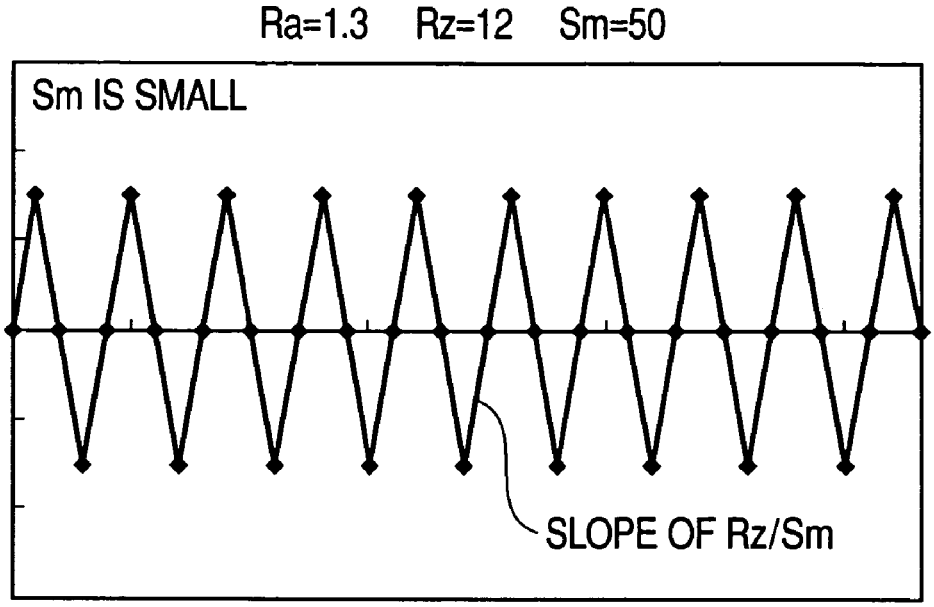
FIGS. 5A and 5B are schematic views showing surface roughness profiles of the developer carrying member at different Sm values.
Figure 5B:
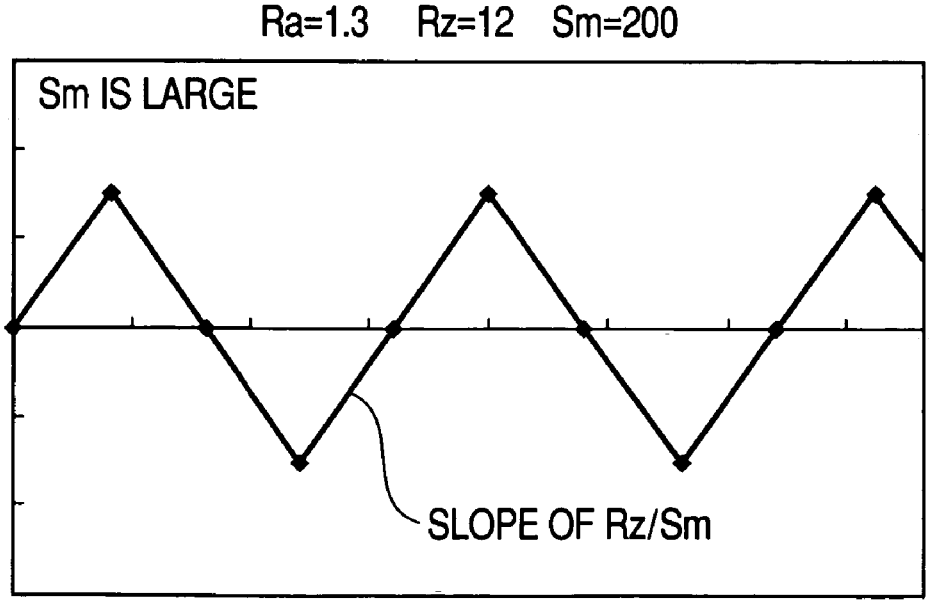

FIGS. 5A and 5B schematically illustrate profiles of surface roughness in developing rollers 23 which are same in Ra and Rz, and different only in Sm. As shown in FIGS. 5A and 5B, Rz/Sm indicates an absolute slope of the roughness profile, and the such slop is steeper in a case of a small Sm or a larger Rz/Sm as shown in FIG. 5A than in a case of a larger Sm or a smaller Rz/Sm as shown in FIG. 5B. Thus the slope becomes steeper as Rz/Sm increases.

Figure 6A:
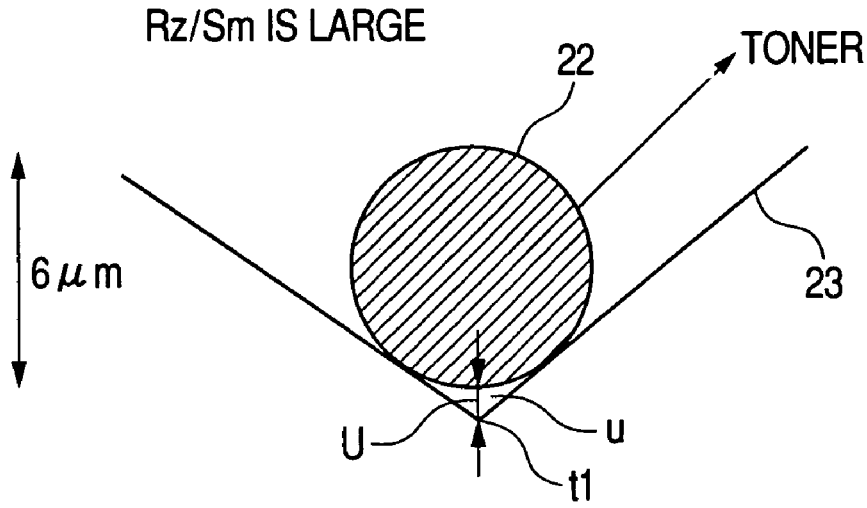
FIGS. 6A and 6B are schematic views showing states of toner in recessed surfaces of different Rz/Sm values.
Figure 6B:
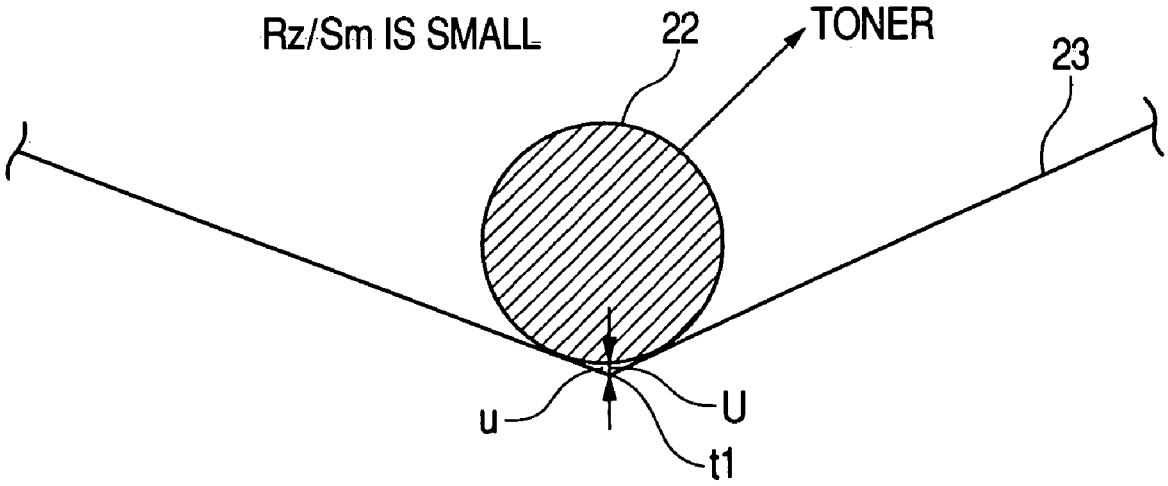

Then, FIGS. 6A and 6B show a state where a toner particle 22 of a particle diameter of 6 μm is held in a recessed portion in the surface irregularities with Rz=12 μm of the developing roller 23. In such situation where the toner 22 on the recess does not reach a most recessed portion t1 of the recess, there exists a gap U between the most recessed portion t1 and the surface of the toner 22, and a height of such U between the most recessed portion t1 and the surface of the toner 22 becomes larger for a larger value of Rz/Sm. Table 4 shows a relationship, for a toner of a particle diameter 6 μm, the gap height U and the surface roughness of the developing roller 23 employed in the present example, shown in Table 2.

TABLE 4

| Rz (μm) | Sm (μm) | Rz/Sm | Gap height U | Ratio Q (%) of gap height U to particle diameter | Fusion bonding |
|---|---|---|---|---|---|
| 5 | 30 | 0.17 | 0.0828 | 5.409 | + |
| 5 | 100 | 0.05 | 0.0075 | 0.499 | + |
| 5 | 170 | 0.03 | 0.0026 | 0.173 | − |
| 8 | 30 | 0.27 | 0.2097 | 13.333 | + |
| 8 | 100 | 0.08 | 0.0192 | 1.272 | + |
| 8 | 155 | 0.05 | 0.0080 | 0.531 | − |

TABLE 4-continued

| Rz (μm) | Sm (μm) | Rz/Sm | Gap height U | Ratio Q (%) of gap height U to particle diameter | Fusion bonding |
|---|---|---|---|---|---|
| 8 | 200 | 0.04 | 0.0048 | 0.319 | – |
| 10 | 30 | 0.33 | 0.3246 | 20.185 | + |
| 10 | 100 | 0.10 | 0.0299 | 1.980 | + |
| 10 | 170 | 0.06 | 0.0104 | 0.690 | – |
| 10 | 220 | 0.05 | 0.0062 | 0.412 | – |
| 12 | 30 | 0.40 | 0.4622 | 28.062 | + |
| 12 | 100 | 0.12 | 0.0430 | 2.840 | + |
| 12 | 170 | 0.07 | 0.0149 | 0.992 | + |
| 12 | 220 | 0.05 | 0.0089 | 0.593 | – |
| 14 | 30 | 0.47 | 0.6212 | 36.789 | + |
| 14 | 100 | 0.14 | 0.0585 | 3.846 | + |
| 14 | 170 | 0.08 | 0.0203 | 1.347 | + |
| 16 | 50 | 0.32 | 0.2997 | 18.727 | + |
| 16 | 100 | 0.16 | 0.0763 | 4.995 | + |
| 16 | 150 | 0.11 | 0.0340 | 2.250 | + |

Relation of Rz/Sm and Gap Height U on Surface Recess of Developing Roller

In Table 4, the ratio (%) of the gap height U to the particle diameter was calculated according to a following equation (14):

$$Q = \left( \frac{T\sqrt{(Sm/4)^2 + (Rz/2)^2}}{(Sm/4)} - (Rz/2) \right) \frac{100}{T} \tag{14}$$

Results shown in Table 4 indicate that a smaller ratio of the gap height U to the particle diameter (ratio of 0.7 or less) causes the fused toner bonding onto the surface of the developing roller 23. More specifically, at the friction of the developing blade 25 and the developing roller 23, a larger gap between the surface of the developing roller 23 and the toner is considered to reduce the fusion because of a smaller friction between the surface of the developing roller 23 and the toner. Results shown in Tables 2 and 3 indicate that a condition $0.7 \leqq Q \leqq 28$ is preferred.

EXAMPLE 5

In the following, there will be explained another example of the image forming apparatus of the present invention.

Figure 7:
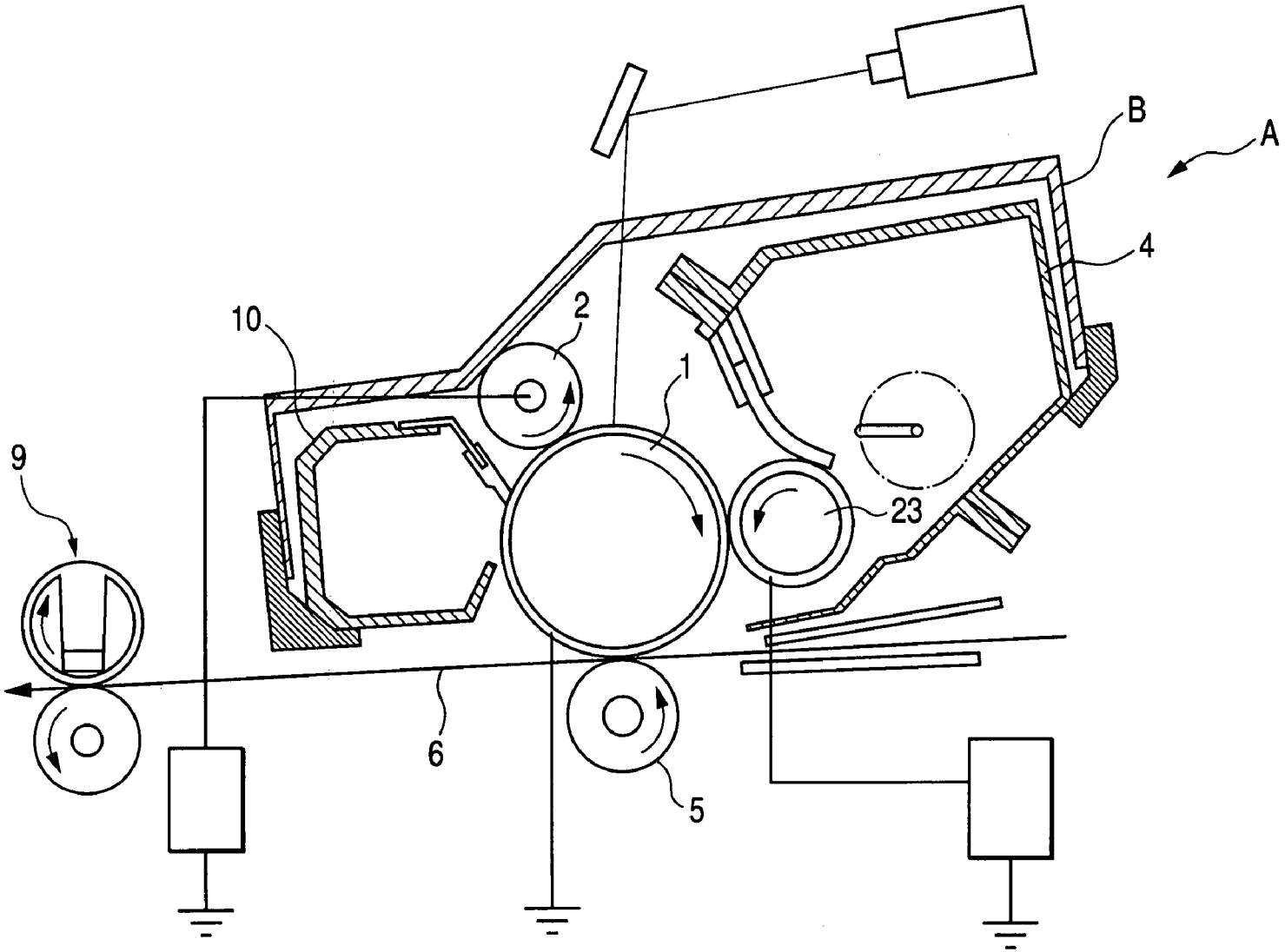
FIG. 7 is a schematic view showing a configuration of another image forming apparatus embodying the present invention.

In the image forming apparatus explained in Example 1, the developing roller 23 constituting the developing means is pressed and abutted on the photosensitive drum 1 so as to form a predetermined penetration. In contrast, the present example utilizes a jumping development for developing a latent image on an image bearing member 1, while a developer carrying member 23 is maintained non-contact with the image bearing member 1, as illustrated in FIG. 7.

Therefore, all the configurations of the developing apparatus explained in Example 1 are similarly applicable to a process cartridge B of the present example. Consequently, the explanation on such configurations and functions thereof in Example is likewise applicable to the present example.

EXAMPLE 6

Figure 8:
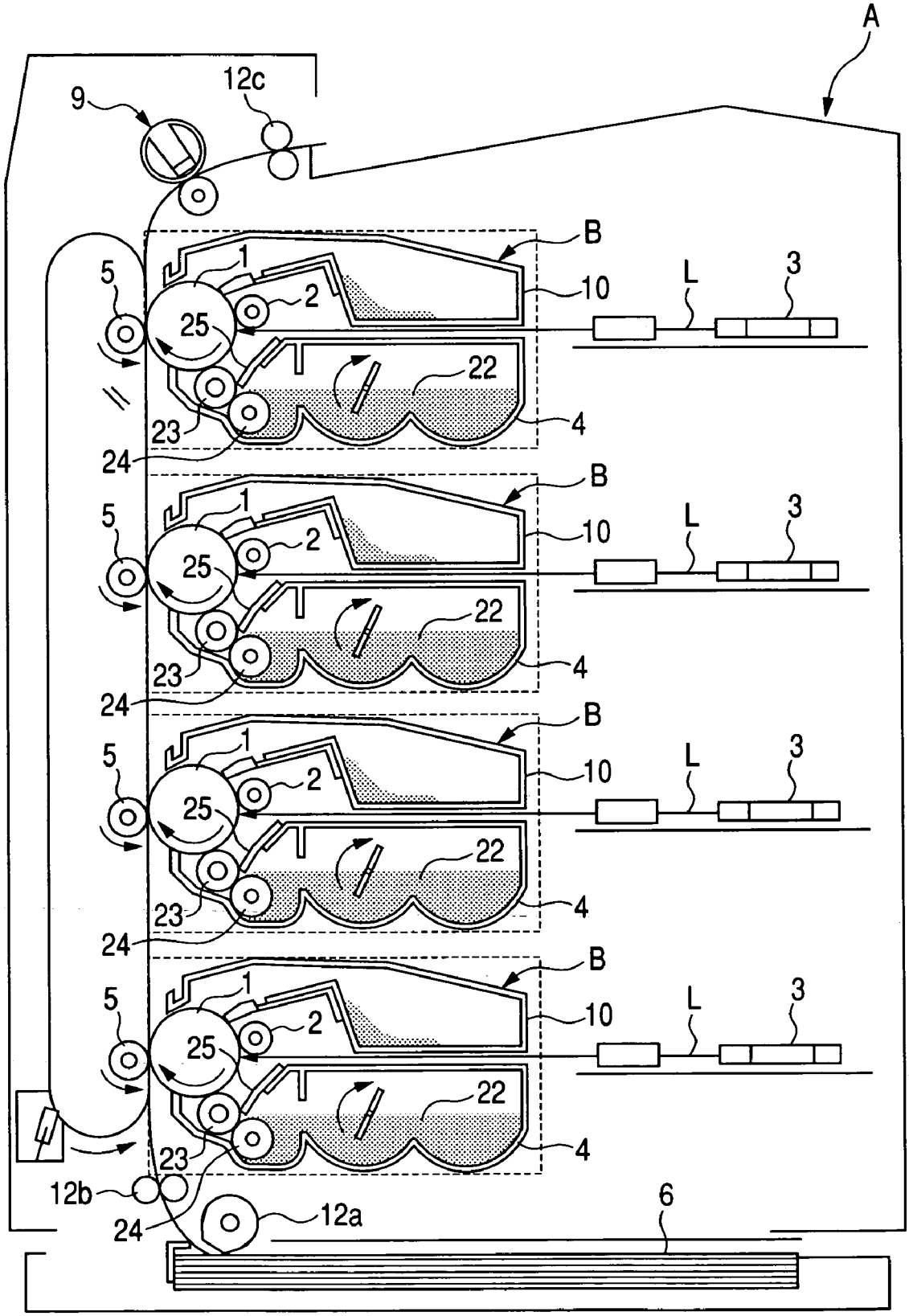
FIG. 8 is a schematic view showing a configuration of another image forming apparatus embodying the present invention.

In the configuration of the image forming apparatus shown in Example 1, in case the image forming apparatus is an in-line full-color laser beam printer having a plurality of process cartridges B which are constructed in a vertical type (vertical direction) as shown in FIG. 8, the inventions explained in Examples 1 to 4 can be applied in the present example to realize a full-color electrophotographic image forming apparatus which does not show a decrease in the triboelectric charging property to the toner even when the toner is deteriorated after an increased number of image formations, thereby not showing a fog problem. In this case, a process cartridge B is provided for each process color. Such configuration, by employing the inventions explained in Examples 1 to 4 to each of the process cartridges B of four colors, similarly allows to obtain an effect of preventing image defects in an increased printing speed. Also the number of the process cartridges is not limited to four.

The present example explains an in-line full-color laser beam printer, but similar effects can also be obtained in a rotary full-color laser beam printer. The present invention is furthermore applicable to a configuration having plural developing apparatuses in fixed manner about a photosensitive drum, or a configuration utilizing an intermediate transfer method, or any modified configuration except for a modification in the configuration of the developing apparatus.

The developing apparatus of the present invention allows to maintain a high fixing ability and can suppress an image defect resulting from a fused toner bonding onto the surface of the developer carrying member even in a high printing speed.

This application claims priority from Japanese Patent Application No. 2004-097060 filed on Mar. 29, 2004, which is hereby incorporated by reference herein.

What is claimed is:

1. A developing apparatus comprising:

a developer carrying member for carrying a developer, the developer carrying member being provided with an elastic layer and adapted to develop, with a developer, an electrostatic image formed on an image bearing member, wherein the developer includes a toner, the toner has a shape factor SF-1 of 100 or more but less than 130, the toner has a storage modulus G' (140° C.) at 140° C. of $2.0\times10^3$ dN/m$^2$ or more but less than $2.0\times10^4$ dN/m$^2$, the toner has a temperature, when the toner has a viscosity of $1.0\times10^3$ Pa·s in a flow tester temperature elevation method, of 115° C. or more but less than 130° C., and in a surface roughness of the developer carrying member, a center-line mean roughness Ra, a ten-point mean roughness Rz and a mean spacing Sm of irregularities satisfy following relationships (1):

$$\left.\begin{array}{l} 0.06 \leq Rz/Sm \leq 0.4 \\ 0.8 \leq Ra \leq 2.0\ (\mu m) \end{array}\right\}. \tag{1}$$

2. A developing apparatus according to claim 1, wherein the toner includes a binder resin and a colorant.

3. A developing apparatus according to claim 2, wherein the binder resin includes a styrene-acryl compound.

4. A developing apparatus according to claim 1, wherein the toner is non-magnetic.

5. A developing apparatus according to claim 1, wherein the toner has a volume-average particle diameter of 4 to 10 μm.

6. A developing apparatus according to claim 1, wherein the temperature is less than 125° C.

7. A developing apparatus according to claim 1, wherein, in a measurement of a wetting property to a mixed solvent of methanol and water by a transmittance at a wavelength of 780 nm, a methanol concentration at a transmittance of 50% is within a range of 30 to 60 vol. %.

8. A developing apparatus according to claim 1, wherein the toner has a shape factor SF-1 less than 125.

9. A developing apparatus according to claim 1, wherein the developer carrying member has a resin layer on a surface thereof.

10. A developing apparatus according to claim 1, wherein the developer carrying member includes a metal core and has a roller shape.

11. A developing apparatus according to claim 1, wherein the developer carrying member has a surface hardness in Asker-C hardness of 40° to 60° and in MD-1 hardness of 25° to 50°.

12. A developing apparatus according to claim 1, further comprising a developer regulating member for regulating an amount of the developer carried on the developer carrying member.

13. A developing apparatus according to claim 1, wherein an amount M/S (mg/cm$^2$) of the developer regulated by the developer regulating member on the developer carrying member satisfies $0.25 \leqq M/S \leqq 0.5$.

14. A developing apparatus according to claim 1, wherein an abutment pressure P (g/cm) of the developer regulating member onto the developer carrying member satisfies $25 \leqq P \leqq 54$.

15. A developing apparatus according to claim 1, wherein the developer regulating member has a free end at an upstream side, in a moving direction of the developer carrying member, of an abutment portion of the developer regulating member and the developer carrying member, and a distance NE (mm) between a most upstream position, in the moving direction of the developer carrying member, in the abutment portion and the free end satisfies following relations (2):

$$\left.\begin{array}{l} 0.5 \leq NE \leq 2.0 \\ 6.0 \times NE + 22 \leq P \leq 6.0 \times NE + 42 \end{array}\right\} \quad (2)$$

where P is the abutment pressure (g/cm) of the developer regulating member.

16. A developing apparatus according to claim 1, wherein for a volume-average particle diameter T (μm) of the toner, a value Q determined from a following equation (3) satisfies a relation $0.7 \leqq Q \leqq 28$:

$$Q = \left( \frac{T\sqrt{(Sm/4)^2 + (Rz/2)^2}}{(Sm/4)} - (Rz/2) \right) \frac{100}{T} \quad (3)$$

* * * * *

UNITED STATES PATENT AND TRADEMARK OFFICE

CERTIFICATE OF CORRECTION

PATENT NO. : 7,209,690 B2
APPLICATION NO. : 11/090282
DATED : April 24, 2007
INVENTOR(S) : Masato Koyanagi et al.

It is certified that error appears in the above-identified patent and that said Letters Patent is hereby corrected as shown below:

ON THE TITLE PAGE:
Item (56), References Cited, Foreign Patent Documents, "JP 2002304053 A * 10/2002" should be deleted.

COLUMN 2:
Line 2, "more" should read --faster--.

COLUMN 3:
Line 33, "developing" should read --developer--.

COLUMN 4:
Line 5, "details." should read --detail.--.
Line 39, "an" should read --a--.

COLUMN 7:
Line 17, "can" should read --an--.

COLUMN 9:
Line 13, "an" should read --a--.
Line 32, "Co" should read --Co.--.

COLUMN 14:
Line 39, "slop" should read --slope--.

Signed and Sealed this

Twenty-seventh Day of November, 2007

JON W. DUDAS
*Director of the United States Patent and Trademark Office*